US006374711B2

(12) United States Patent
Anderson et al.

(10) Patent No.: US 6,374,711 B2
(45) **Date of Patent: *Apr. 23, 2002**

(54) 50-IN-1 SCREWDRIVER AND SOCKET DRIVER

(76) Inventors: Wayne Anderson, 65 Grove St.; Paolo Cassutti, 8 N. Creek Rd., both of Northport, NY (US) 11768

( * ) Notice: Subject to any disclaimer, the term of this patent is extended or adjusted under 35 U.S.C. 154(b) by 0 days.

This patent is subject to a terminal disclaimer.

(21) Appl. No.: 09/435,709

(22) Filed: Nov. 8, 1999

Related U.S. Application Data

(63) Continuation-in-part of application No. 09/168,637, filed on Oct. 8, 1998, now Pat. No. 6,209,428, which is a continuation-in-part of application No. 08/960,090, filed on Oct. 24, 1997, now Pat. No. 5,819,612, and a continuation-in-part of application No. 08/977,453, filed on Nov. 24, 1997, now Pat. No. 5,904,080.

(51) Int. Cl.[7] ..... B25G 1/08

(52) U.S. Cl. ..... 81/490; 81/177.4; 81/439

(58) Field of Search ..... 81/438, 439, 490, 81/177.4

(56) References Cited

U.S. PATENT DOCUMENTS

| | | | | | |
|---|---|---|---|---|---|
| 4,798,111 | A | * | 1/1989 | Cheeseman | 81/177.4 X |
| 5,499,562 | A | * | 3/1996 | Feng | 81/490 X |
| 5,819,612 | A | * | 10/1998 | Anderson | 81/439 X |
| 5,868,048 | A | * | 2/1999 | Cassutti et al. | 81/490 X |
| 6,050,158 | A | * | 4/2000 | Cassutti et al. | 81/439 X |

* cited by examiner

*Primary Examiner*—James G. Smith
(74) *Attorney, Agent, or Firm*—Lackenbach Siegel LLP

(57) ABSTRACT

A hand tool provides 11 double-headed tool bits for a multiple-in-1 screwdriver function and a 6-in-1 socket driver functions in an ergonomically designed handled having a removable handle cap. The handle cap selectively receiving each of the 11 double-head tool bits for a multiple-in-1 screwdriver function.

9 Claims, 3 Drawing Sheets

50-IN-1 SCREWDRIVER AND SOCKET DRIVER

PRIOR RELATED APPLICATIONS

This application is a continuation-in-part of U.S. Ser. No. 09/168,637, filed Oct. 8, 1998, now U.S. Pat. No. 6,209,428, which is a continuation-in-part of U.S. Ser. No. 08/960,090, filed Oct. 24, 1997, now U.S. Pat. No. 5,819,612, and a continuation-in-part of U.S. Ser. No. 08/977,453, filed Nov. 24, 1997, now U.S. Pat. No. 5,904,080, granted May 18, 1999.

FIELD OF THE INVENTION

This invention relates to hand tools. This invention relates to a hand tool which is a combination screwdriver and socket driver.

BACKGROUND AND DISCUSSION OF THE PRIOR ART

The hand tool art traditionally manufactured tool sets, such as screwdriver sets and socket wrench sets. These sets were comprised of multiple hand tools to accomplish different tool bit drive functions as well as to accomplish differently sized similar tool bit drive functions. Prior art commercial screwdriver sets would, typically, include from eight (8) to twenty-two (22) screwdrivers. Commercial socket wrench sets and tool bit drive sets required specialized mounting and storage for the large pluralities of socket drives and tool bit drives.

The art desired multiple tool bit drive combination tools to reduce the mounting and storage requirements. Rocca, U.S. Pat. No. 4,448,097 granted May 15, 1994, disclosed a complex multiple piece construction which provided a total of six (6) tool bit drive functions and two (2) nut driver means functions. Kozak, U.S. Pat. No. 5,450,775 granted Sep. 19, 1995, disclosed a multiple tool bit drive function of complex housing design. These complex designs provided limited multiple drive functionality.

One prior art combination screwdriver and socket driver is shown in attached FIG. 1. Prior art tool 10 is formed of a conventional handle 11 having at its proximate end 15, a well 12 for loosely holding up to six single-ended hexagonal body bit drives 13 (typical). A handle cap 14 is screwed onto the proximate end of 15 handle 11 to hold the loosely stowed bit drives 13 in well 12. A hexagonal shank or shaft 18 is fixedly held in handle 11 at handle distal end 19. A plurality of three double-ended socket drives 20, 21 and 28 are formed with hexagonal through holes 22, 23 and 24, respectively, so as to be slidably non-rotatably received on shank 18. The most distally disposed socket drive end 25 is available for socket drive use in turning handle 11. In the screwdriver operational mode (FIG. 1), one of the bit drives 13 is slidably non-rotatably received in the hexagonal socket through hole 24 for torque transmission. The flat end 26 of the operably disposed bit drive 13 abuts end 29 of shank 18. The FIG. 1 tool is generally a 6-in-1 screwdriver and a 6-in-1 socket driver, or at most, a 12-in-1 tool.

The FIG. 1 prior art tool has existed for man years but with limited commercial acceptance. The art desired a significantly more versatile screwdriver an socket driver combination. The present invention addresses that need and provides an improved multiple-in-1 screwdriver and socket driver combination hand tool.

SUMMARY OF THE INVENTION

The hand tool is a combination multiple drive screwdriver and socket driver. A plurality of 3 double-ended socket drives are slidably non-rotatably nested on the shank of the screwdriver, whereby the most distally disposed socket drive end is operable with turning the screwdriver handle. The handle is ergonomically designed with a plurality of contiguous parallel cylindrical compartments. The handle is of regular polygonal cross-section, preferably square, with an elongated cylindrical compartment disposed at each corner, and a large diameter centrally disposed elongated cylindrical compartment is contiguous with the corner compartments. In a square handle there are then four corner compartments and one contiguous central compartment. Each compartment is sized to slidably receive two bit drives, with each bit drive having a body and oppositely disposed tool bits. One additional double-ended bit drive is operably disposed at the distal end of the shank. Eleven double-ended bit drives are contained in the one tool. A removable handle cap is provided which is frictionally held to the proximate end of the handle. The handle cap is provided with a centrally disposed metal insert for slidably non-rotatable receiving one of the eleven double-ended bit drives for handle cap driver or stubby screwdriver use. The combination hand tool is a multiple-in-1 screwdriver, a multiple-in-1 handle cap driver or stubby screwdriver and a 6-in-1 socket driver.

DESCRIPTION OF THE INVENTION

Figure 3:
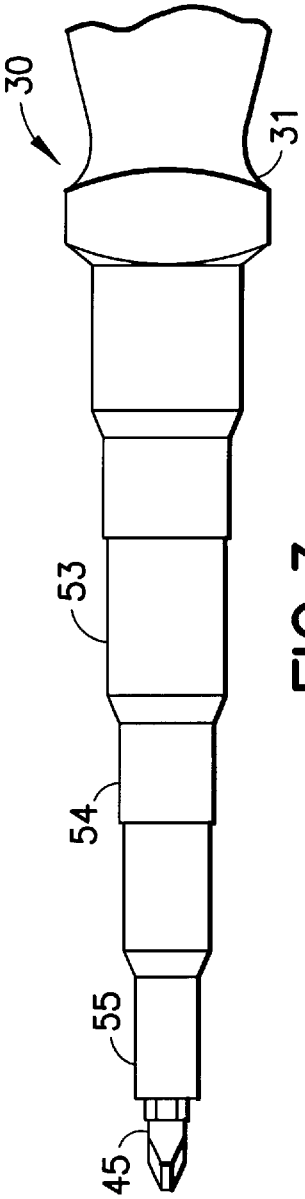
FIG. 3 is a partial side view of the tool as shown in FIG. 2.
Figure 4:
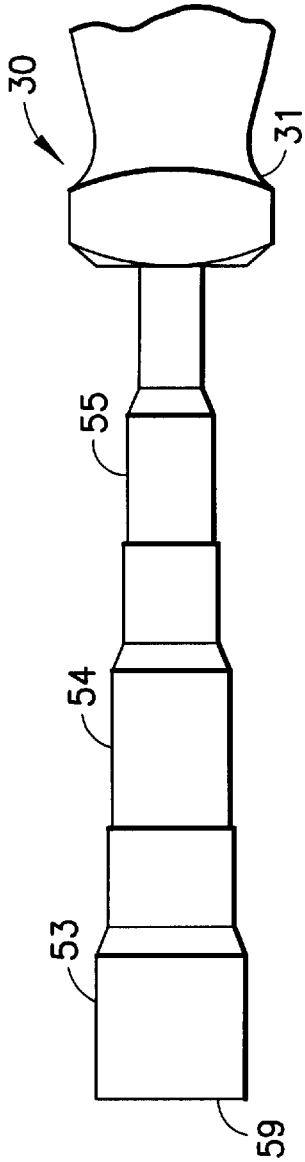
FIG. 4 is a partial side view of the tool as in FIG. 3 but arranged in a reversed socket drive operational mode.
Figure 5:
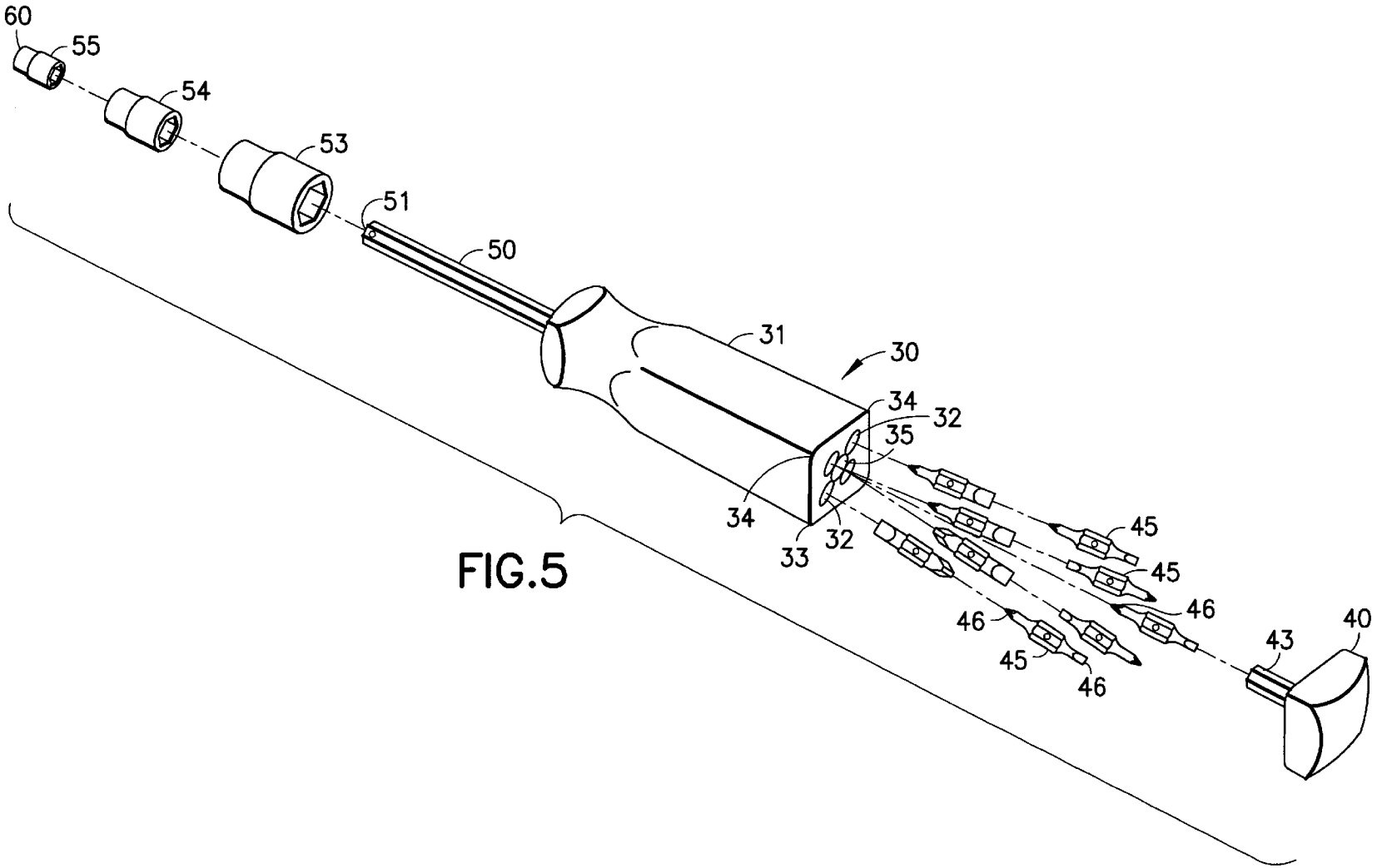
FIG. 5 is an exploded perspective view of the tool of FIG. 2.

Referring to FIGS. 2–7, there is shown the present combination screwdriver and socket driver tool 30. Tool 30 has a clear or transparent plastic handle 31 of generally square cross section. Four equal diameter elongated cylindrical compartments 32 are disposed at the proximate end 33 of handle 31 and extend distally. Each compartment 32 is disposed adjacent a respective corner 34 of the handle, as best shown in FIG. 5. A central compartment 35 of larger diameter than the corner compartments 32 is provided for purposes hereinafter appearing. The handle 31 is configured and the compartments 32 and 35 are disposed and contiguous so as to provide an ergonomic design for maximum bit drive storage, as is more fully described in applicants' U.S. Pat. No. 5,819,612, granted Oct. 13, 1998, which disclosure is incorporated herein by reference thereto.

Handle cap 40 is of generally square cross-section and is frictionally slidably received on proximate end 33 of handle 31 as at 41 to form a smooth conforming outer surface or structure. Cap 40 is formed with central hexagonal recess 42 for fixedly receiving hexagonal metal sleeve 43, for purposes hereinafter appearing.

A plurality of double-ended bit drives 45 are provided, with each bit drive 45 having a hexagonal body portion and oppositely disposed tool bits 46. Each tool bit 46 may be of any desired configuration and differently sized. Useful tool bit 46 configurations are for, by way of example, Philips head, slot head, square head, and like known tool element uses.

Figure 1:
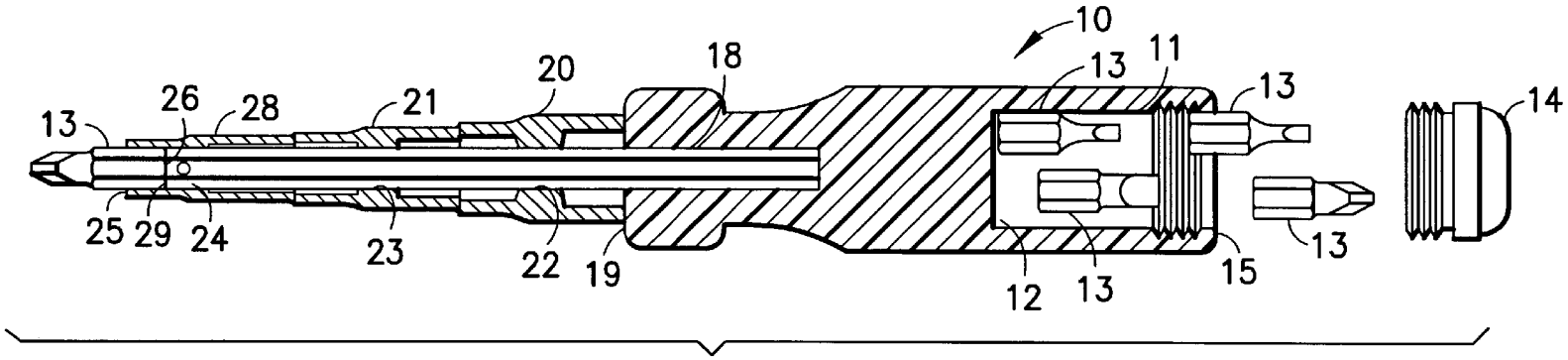
FIG.1 PRIOR ART
FIG. 1 is a partial sectional, partial exploded view of the Prior Art screwdriver and socket driver tool.
Figure 2:
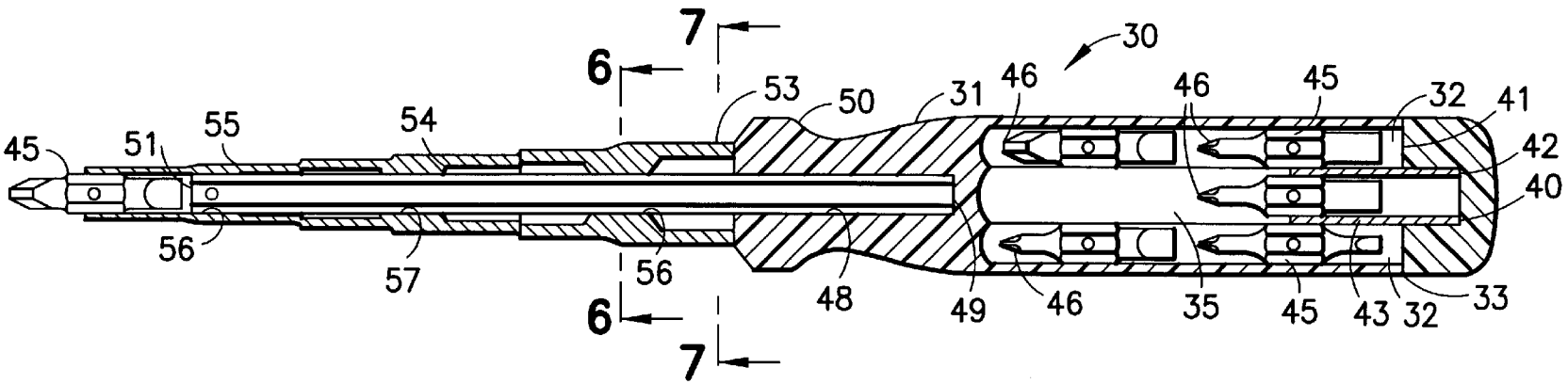
FIG. 2 is a partial sectional, partial fragmentary view of the combination screwdriver and socket driver tool of the present invention shown in the screwdriver operational mode.
Figure 7:
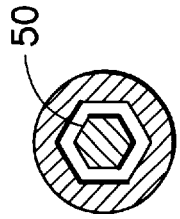
FIG. 7 is a sectional view taken along line 7—7 of FIG. 2.
Figure 6:
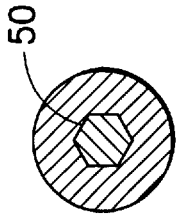
FIG. 6 is a sectional view taken along line 6—6 of FIG. 2.

Handle 31, at its distal end, is formed with a central hexagonal hole 48 for fixedly receiving proximate end 49 of hexagonal shaft or shank 50. Shank 50 extends to shank distal end 51. A set of three double-ended socket drives 53, 54 and 55 are formed with common hexagonal axial through holes 56, 57 and 58, respectively, so as to be slidably non-rotatably received on shank 50. The socket drives 53, 54 and 55 may be disposed in various nested arrangements so that the most distal drive end, e.g. 60 in FIG. 5 and 59 in FIG. 4, is operably disposed (i.e. without any bit drive 45 disposed at the shank distal end). With the turning of handle 31, torque is transmitted though shank 50 to the socket drives. When a selected bit drive 45 is slidably non-rotatably received in the most distally disposed socket drive end, the distal end tool bit 46, as best shown in FIGS. 2 and 3, is operably disposed for selected screwdriver use.

The handle cap sleeve 43 is sized to slidably non-rotatably receive a selected bit drive 45 (FIG. 2) so that with removal of cap 40, cap 40, with selected bit drive 45 in place functions as a handle cap or stubby screwdriver.

Two additional bit drives 45 can also be slidably received and stowed in each handle compartment. Two bit drives 45 can be stowed in the handle central compartment. One additional bit drive (not shown) can be disposed at the distal end of central compartment with the bit drive received in cap sleeve 43. In total, 10 bit drives can be stowed in the handle and handle cap. Additionally, a bit drive 45 can be received at shank distal end as show in FIGS. 2 and 3. In this manner of construction, 11 double-ended bit drives are provided so that there is multiple-in-1 screwdriver functionally and multiple-in-1 handle cap or stubby screwdriver functionality. The present hand tool also provides three double-ended socket drives for 6-in-1 socket driver functionality. In total, hand tool 30 is a multiple-in-1 screwdriver, a multiple-in-1 handle cap driver and a 6-in-1 socket driver.

Each bit drive 45 is provided with a spring loaded ball of conventional design so that the bit drive is held axially in place when inserted into the handle cap sleeve 43 or the most distally disposed socket end.

The bit drives of the present invention have a hardness range of from about 53 to about 57 C scale, and are made from an alloy steel having properties of desired strength and toughness, as well as requisite flexibility. A more preferred hardness range, on the other hand, is from about 54 to about 55 Rockwell C scale, using an oil-hardening alloy spring steel having relatively higher amounts of silicon and manganese than other plain carbon tools or alloy tool steels. Hand gripping portion is generally constructed from molded clear plastic, such as a polycarbonate or the like.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A hand tool comprising:

a handle, said handle having a proximate end and a distal end, said handle proximate end being formed with elongated compartments;

a plurality of interchangeable tool bits; further comprising a handle cap, said handle cap being removably disposed on the handle proximate end to cover the compartments, said handle compartments being sized to slidably receive said tool bits;

a shank, said shank having a proximate end and a distal end, and means for connecting said shank proximate end to said handle distal end;

a plurality of socket drives, said socket drives being sized to be slidably non-rotatably received on said shank in a plurality of nested arrangements so that the one of said socket drives is operably disposed at the shank distal end; and one of said tool bits is slidably non-rotatably received at the shank distal end;

said handle proximate end being formed with a centrally disposed elongated compartment for slidably receiving at least one said tool bit.;

said handle cap comprising a centrally disposed sleeve, said handle cap sleeve being sized to be slidably received in the handle central compartment, said handle cap sleeve being formed to slidably non-rotatably receive one of said tool bits, whereby with the handle cap removed from the handle, the handle cap with the tool bit received in the handle cap sleeve is a driver whereby the hand tool is alternatively a multiple screwdriver and a multiple socket driver.

2. A hand tool comprising:

a handle, said handle having a proximate end and a distal end, said handle proximate end being formed with distally extending elongated compartments;

a plurality of interchangeable tool bits;

said handle compartments being sized to slidably receive said tool bits;

a shank, said shank having a proximate end and a distal end, and means for connecting said shank proximate end to said handle distal end;

a plurality of socket drives, said socket drives being sized to be slidably non-rotatably received on said shank in a plurality of nested arrangements so that one socket drive is operably disposed at the shank distal end;

one said tool bit being slidably non-rotatably received at the shank distal end;

further comprising a handle cap, said handle cap being removably disposed on the handle proximate end to cover the compartments, said handle cap being formed with a centrally disposed sleeve, said handle cap sleeve being formed to slidably non-rotatably receive one said tool bit, whereby with the handle cap removed from the handle, the handle cap with the selected tool bit received in the handle cap sleeve is a driver, whereby the hand tool is, alternatively, a multiple screwdriver and multiple socket driver.

3. The hand tool of claim 2, said handle compartments being contiguous.

4. The hand tool of claim 2, said handle compartments being cylindrical and further comprising a central compartment and corner compartments, said central compartment having a larger diameter than said corner compartments.

5. The hand tool of claim 4, said handle having a square cross-section, and said four handle corner compartments being disposed at respective corners of the square handle.

6. A multiple-in-1 hand tool comprising:

a handle;

a shank;

a handle cap;

interchangeable tool bits;

said handle comprising means for holding said shank;

said handle and handle cap being formed with cooperative means for removably holding said handle cap from said handle;

said handle comprising a centrally disposed cavity and radially disposed cavities for holding said tool bits;

said handle cap comprising a centrally disposed cavity for holding said tool bits; and said shank comprising a distally disposed cavity for holding said tool bits; whereby with the cap removed, the cap with at least one tool bit comprises a second hand tool.

7. The hand tool of claim 6, said tool bits comprising double-ended tool bits.

8. The hand tool of claim 7, wherein said handle comprises four radially disposed cavities.

9. The hand tool of claim 8, wherein said handle comprises a proximate end juxtaposed to the handle cap, and wherein with the handle cap held on the handle, five double ended tool bits are disposed adjacent the handle proximate end.

* * * * *